United States Patent [19]

Nilssen

[11] Patent Number: 5,017,838

[45] Date of Patent: May 21, 1991

[54] ELECTRONIC INCANDESCENT LIGHTING PRODUCT

[76] Inventor: Ole K. Nilssen, Caesar Dr., Barrington, Ill. 60010

[21] Appl. No.: 470,392

[22] Filed: Jan. 25, 1990

Related U.S. Application Data

[63] Continuation of Ser. No. 837,759, Mar. 10, 1986, abandoned.

[51] Int. Cl.[5] ..... H05B 39/00; H05B 41/14

[52] U.S. Cl. ..... 315/200 R; 315/70; 315/219; 315/DIG. 7

[58] Field of Search ..... 315/200 R, 219, 105, 315/108, 70

[56] References Cited

U.S. PATENT DOCUMENTS

| | | | |
|---|---|---|---|
| 2,587,169 | 2/1952 | Kivari | 315/70 |
| 3,525,012 | 8/1970 | Dimitracopoulos et al. | 315/70 |
| 4,163,176 | 7/1979 | Cohen et al. | 315/70 |
| 4,207,497 | 6/1980 | Capewell et al. | 315/96 |
| 4,443,778 | 4/1984 | Mewissen | 315/70 |
| 4,480,212 | 10/1984 | Monahan et al. | 315/200 R |

*Primary Examiner*—Eugene R. LaRoche
*Assistant Examiner*—Son Dinh

[57] ABSTRACT

At the lumen output levels of most ordinary household incandescent lamps, incandescent filaments designed for and operated at about 24 Volt RMS provide substantially higher luminous efficacy than filaments designed for and operated at 120 Volt RMS.

A frequency converter, which is adapted to be plugged into and held by an ordinary household electric receptacle, coverts the 120 Volt/60 Hz received from the power line to an output of 120 Volt/30 kHz and provides this output at a receptacle adapted to receive and hold an ordinary power plug.

The power plug of an ordinary table lamp is plugged into this frequency converter, thereby providing 120 Volt/30 kHz to its lamp socket instead of the normal 120 Volt/60 Hz.

With 120 Volt/30 kHz on the lamp socket, any ordinary 120 Volt incandescent lamp can be used therein; as can also any special incandescent lamp having a 24 Volt filament in combination with a built-in 30 kHz voltage transformer operative to convert the 120 Volt/30 kHz socket voltage into 24 Volt/30 kHz voltage for the filament.

While the size of a 60 Hz transformer capable of efficiently transforming the amount of power required by the 24 Volt filament would be far too large to be contained within a light bulb of ordinary dimensions; the size of a corresponding 30 kHz transformer is small enough to fit comfortably within the dimensions of an ordinary light bulb.

20 Claims, 2 Drawing Sheets

ELECTRONIC INCANDESCENT LIGHTING PRODUCT

This application is a continuation of Ser. No. 837,759 filed Mar. 10, 1986, abandoned.

BACKGROUND OF THE INVENTION

1. Field of Invention

The present invention relates to means by which to provide incandescent lighting products operable to provide light at a particularly high degree of luminous efficacy.

2. Prior Art

Previous efforts at achieving significantly improved luminous efficacy in incandescent light bulbs—i.e., light bulbs adapted to screw into ordinary lamp sockets and to operate on 120 Volt RMS—have been directed toward the use of means operative to reflect infrared radiation back onto the incandescent filament while letting visible light pass through.

Examples of approaches of this nature are provided by numerous prior art references, such as the following U.S. Pat. No. 1,342,894 to Bugbee; No. 1,425,967 to Hoffman; No. 2,859,369 to Williams et al.; No. 4,039,878 to Eijkelenboom et al.; No. 4,160,929 to Thorington et al.; No. 4,283,653 to Brett; No. 4,366,407 to Walsh; and No. 4,375,605 to Fontana et al.

However, even though the basic principle has been known for decades, and even though the potentially attainable efficacy improvement is on the order of several hundred percent, household light bulbs based on this principle of selective reflection of infrared energy is not yet available on the market. The reason for this is apparently connected with difficulties in translating the basic principle into high-volume production of corresponding cost-effective household light bulbs.

SUMMARY OF THE INVENTION

Objects of the Invention

An object of the present invention is that of providing an incandescent lighting product capable of providing light at particularly high luminous efficacy.

Another object is that of providing an incandescent lighting product that has exceptionally long life expectancy, yet without the normally concomitant descrease in luminous efficacy.

A third object is that of providing a special light bulb having increased luminous efficacy and/or life expectancy.

A fourth object is that of providing a converter means operative to permit conversion of an ordinary table lamp such that it can effectively be used with a special light bulb having increased luminous efficacy and/or life expectancy.

These as well as other objects, features and advantages of the present invention will become apparent from the following description and claims.

BRIEF DESCRIPTION

A table lamp is plugged into a frequency converter that, in turn, in plugged into and held in place by an ordinary household electric receptacle. With an input of 120 Volt/60 Hz, the output from the frequency converter is 120 Volt/30 kHz; which output is therefore supplied to the lamp socket.

A special incandescent light bulb has a 24 Volt filament and is operative to be properly powered by a 120 Volt/30 kHz voltage applied to the base electrodes of its ordinary Edison-type screw base. This special light bulb comprises transformer means connected in circuit between its base electrodes and the filament; and this transformer means is operative to transform 120 Volt/30 kHz applied at the base electrodes to 24 Volt/30 kHz applied to the filament.

The transformer means has built-in high-pass filter means operative to prevent damage in case the special light bulb were to be inserted into a lamp socket having ordinary power line voltage applied thereto.

Thus, the special light bulb may be used in and properly powered from the lamp socket of the table lamp, as can ordinary 120 Volt light bulb as well.

PROBLEM SITUATION UNDERLYING THE INVENTION

Figure 1:
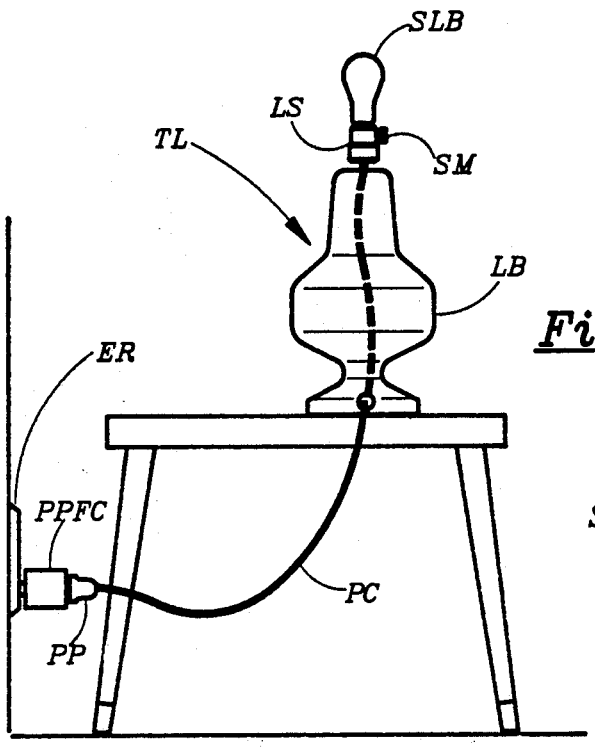
FIG. 1 illustrates the preferred embodiment of the invention and shows a table lamp having a special light bulb in its socket and being plugged into an ordinary household electric receptacle by way of a plug-in frequency conversion means.

The present invention is based on the recognition that significant improvements in the luminous efficacies of incandescent light bulbs can be attained by making their filaments substantially heavier than the filaments presently used in ordinary 120 Volt household light bulbs.

However, a heavier filament would require an operating current of higher magnitude, and would therefore cause more power to be drawn by the filament—as long as the magnitude of the voltage applied to the filament were to remain 120 Volt.

Of course, if it had been possible to incorporate a voltage transformer within the light bulb, a lower-voltage filament could be used, thereby attaining the desired efficacy improvement without concomitantly increasing total filament power. However, at the power levels (25 to 100 Watt) required by most ordinary household incandescent light bulbs, the size and weight of such a transformer—that is, a transformer capable of converting the 120 Volt/60 Hz power line voltage to a substantially lower-magnitude voltage for application to the filament—would be so large as to prevent it from being incorporated into a light bulb of anywhere near ordinary dimensions. That is, at a frequency of 60 Hz, it must be considered totally non-feasible to provide for a voltage transformer as a built-in part of an otherwise ordinary light-bulb.

Absent other considerations, since the size and weight of a transformer is more-or-less inversely proportional to the frequency of the voltage being transformed, and if power to the light bulb could be provided at a frequency substantially higher than 60 Hz, a point would be reached where the size and weight of the requisite transformer would become small enough to fit within the confines of a light bulb of ordinary proportions.

For instance, if the frequency of the voltage provided to power the light bulb were to be 30 kHz or so, the requisite built-in transformer would be smaller and lighter by a factor of more than 50—even after taking into account the particular characteristics of the magnetic materials required for such a high frequency.

Indeed, well within the physical dimensions of an ordinary light bulb, it is then possible to provide a special light bulb having built-in transformer means operable to convert a relatively high-magnitude 30 kHz voltage into a relatively low-magnitude 30 kHz voltage. Specifically and by way of example, it is indeed feasible to provide a built-in transformer operable to convert 120 Volt/30 kHz to 24 Volt/30 kHz, thereby providing for a light bulb operative to be powered from a source of 120 Volt RMS yet having a filament designed for operation on 24 Volt.

However, since there exist no lamp sockets providing 120 Volt/30 kHz voltage, a light bulb designed for operation on such 120 Volt/30 kHz voltage would have no utility.

So, as the next link in the problem situation underlying the invention, it is necessary to create a situation in which such a special light bulb would indeed have utility; and this next link involves the creation of lighting system or a lighting product, such as a table lamp (or a floor lamp), wherein the socket voltage is 120 Volt/30 kHz.

On the other hand, in a special table lamp, it would be relatively easy to provide 24 Volt to the socket, thereby obviating the need for having a transformer built into the light bulb. Doing so, however, would prevent ordinary light bulbs from being used in that table lamp; which might make things very inconvenient for the user of that table lamp, and would probably not constitute a commercially acceptable solution.

Moreover, the requirement of having something special built into the table lamp would limit applicability to new products; and would not permit the use of such special high-efficacy light bulbs in ordinary table lamps.

The solution provided by instant invention recognizes these various issues and provides for a situation where any ordinary table may be plugged into a frequency converter that, in turn, is plugged into a regular 120 Volt/60 Hz power receptacle. The output from this inverter is a 120 Volt/30 kHz voltage, which is then provided to the lamp socket of the table lamp, thereby making this lamp socket fully operable to power a special light bulb requiring 120 Volt/30 kHz for its proper operation as well as any ordinary 120 Volt light bulb. Thus, the above concerns are obviated.

In other words, the special light bulb herein described does not represent a solution to any presently known problem—if for no other reason that, except in connection with the present invention, it would have no publicly known utility at the present time. Likewise, the plug-in/plug-into frequency converter herein described does not represent a solution to any presently known problems—if for no other reason that, except in connection with the present invention, it would have no publicly known utility at the present time.

However, even though some of the individual elements of the invention do not have any utility, in overall combination the resulting lighting product represents a unique solution to the general problem of providing incandescent lighting having improved luminous efficacy and/or increased lamp durability.

DESCRIPTION OF THE PREFERRED EMBODIMENT

Details of Construction

FIG. 1 illustrates the preferred embodiment of the invention.

In FIG. 1, an ordinary table lamp TL has a lamp base LB and a lamp socket LS with a switch means SM. Plugged into a plug-in/plug-into frequency converter PPFC is a power plug PP which, by way of power cord PC connects with lamp socket LS. Plug-in/plug-into frequency converter PPFC is itself plugged into and held by an ordinary household electric receptacle ER.

A special light bulb SLB is screwed into lamp socket LS; which lamp socket is of a type adapted to receive an ordinary Edison-type light bulb.

Figure 2:
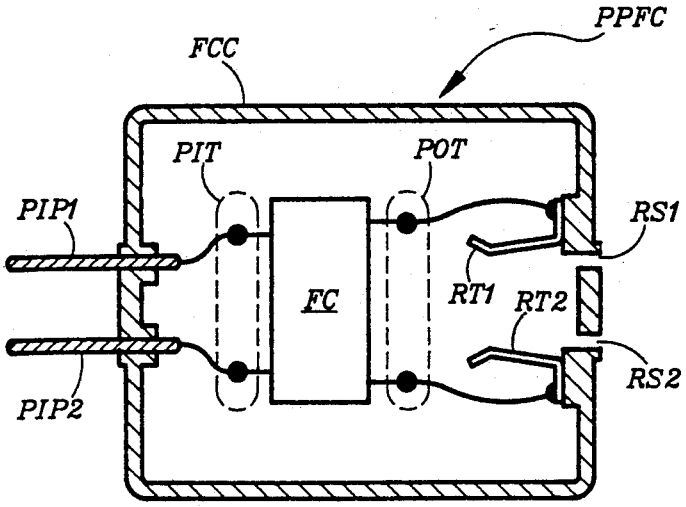
FIG. 2 illustrates the plug-in/plug-into frequency converter means.

FIG. 2 illustrates in more detail the plug-in/plug-into frequency converter means PPFC.

In FIG. 2, power input prongs PIP1 and PIP2 are rigidly mounted on frequency converter case FCC in such manner that these prongs can be plugged directly into and be held by an ordinary household electric receptacle such as ER of FIG. 1.

Electrically connected with power input prongs PIP1 and PIP2 are power input terminals PIT of a frequency converter FC. Power output terminals POT of frequency converter FC are connected with receptacle terminals RT1 and RT2; which receptacle terminals are rigidly mounted on frequency converter case FCC in such manner that an ordinary electric power plug, such as PP of FIG. 1, can be plugged into receptacle slots RS1 and RS2 and make contact with and be held by receptacle terminals RT1 and RT2.

Figure 3:
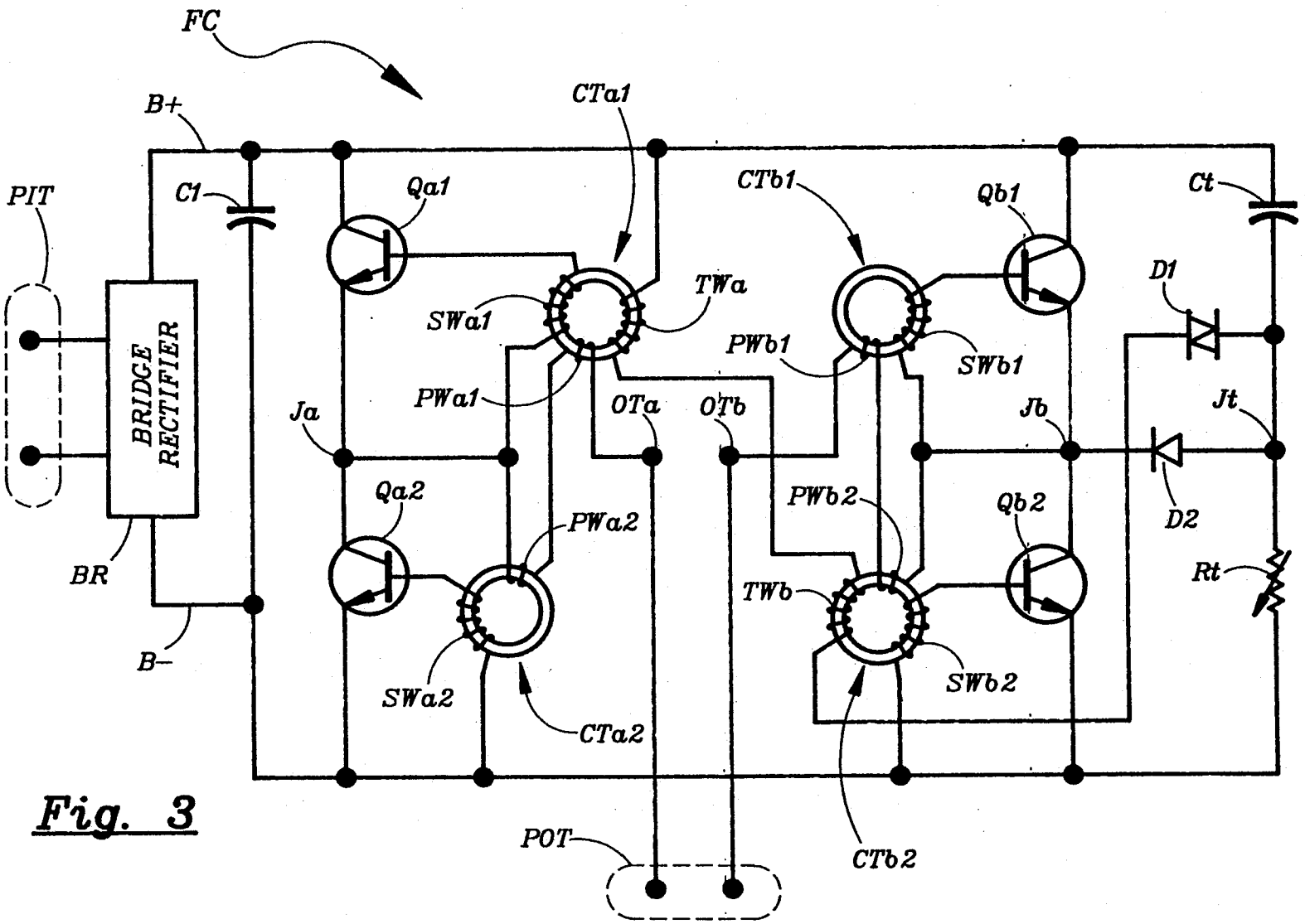
FIG. 3 is an electrical circuit diagram of the frequency converter means.

FIG. 3 constitutes an electric circuit diagram of frequency converter FC.

In FIG. 3, a bridge rectifier BR has a pair of power input terminals PIT adapted to connect with ordinary 120 Volt/60 Hz power line voltage.

The positive voltage output from rectifier BR is connected with a B+ bus; and the negative voltage output from rectifier BR is connected with a B− bus. A capacitor C1 is connected betweeen the B+ bus and the B− bus.

A transistor Qa1 is connected with its collector to the B+ bus and with its emitter to a junction Ja. Another transistor Qa2 is connected with its collector to junction Ja and with its emitter to the B− bus.

Similarly, a transistor Qb1 is connected with its collector to the B+ bus and with its emitter to a junction Jb; while yet another transistor Qb2 is connected with its collector to junction Jb and with its emitter to the B− bus.

The base of transistor Qa1 is connected with junction Ja by way of secondary winding SWa1 on current transformer CTa1; and the base of transistor Qa2 is connected with the B− bus by way of secondary winding SWa2 of current transformer CTa2.

Similarly, the base of transistor Qb1 is connected with junction Jb by way of secondary winding SWb1 on current transformer CTb1; and the base of transistor Qb2 is connected with the B−bus by way of secondary winding SWb2 of current transformer CTb2.

An output terminal OTa is connected with junction Ja by way of series-connected primary windings PWa1 and PWa2 of current transformers CTa1 and CTa2, respectively.

Another output terminal OTb is connected with junction Jb by way of series-connected primary windings PWb1 and PWb2 of current transformers CTb1 and CTb2, respectively.

A capacitor Ct is connected between the B+ bus and a junction Jt; and an adjustable resistor Rt is connected between junction Jt and the B− bus. A Diac D1 from junction Jt to the B+ bus by way of series-connected tertiary windings TWa and TWb of current transformers CTa1 and CTb2, respectively. A diode D2 is connected with its cathode to junction Jt and with its anode to junction Jb.

Figure 4:
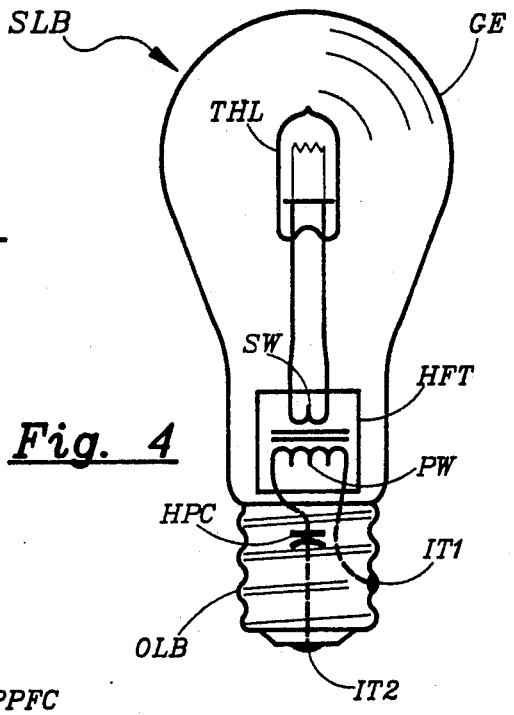
FIG. 4 shows details of the special light bulb.

FIG. 4 illustrates the special light bulb SLB used in lamp socket LS of FIG. 1. Special light bulb SLB has the size and shape of an ordinary household incandescent light bulb, and comprises a built-in high-frequency transformer HFT and a Tungsten-Halogen lamp THL.

The transformer has a primary winding PW connected between input terminals IT1 and IT2 of screw-in "one-way" lamp base OLB by way of high-pass capacitor HPC; and it has a secondary winding SW connected directly with the terminals of Tungsten-Halogen lamp THL. Both the transformer and the Tungsten-Halogen lamp are enclosed within a glass envelope GE.

Details of Operation

With power plug PP of FIG. 1 plugged into plug-in/plug-into frequency converter PPFC there is a direct electrical connection between the output of the frequency converter and the socket terminals of lamp socket LS—provided the switch on the lamp socket is placed in its ON-position.

Thus, any voltage provided from the output of the frequency converter is provided to the socket terminals, and therefore to the terminals of a special light bulb SLB (or to any ordinary light bulb) screwed into the lamp socket. If then the plug-in/plug-into frequency converter is plugged into electric receptacle ER, a 120 Volt/30 kHz voltage will be provided to input terminals IT1 and IT2 of special light bulb SLB (or to the ordinary light bulb).

With the frequency converter plugged into an electric receptacle, power to the special light bulb may be switched ON and/or OFF by a switch on the lamp base or on the lamp socket.

If power to the special light bulb is switched OFF, the output provided from the frequency converter essentially disappears—as will be understood from the following explanation of the frequency converter circuit.

The frequency converter of FIG. 3 comprises a bridge rectifier (BR) operative to provide unfiltered full-wave-rectified 120 Volt/60 Hz power line voltage between the B+ bus and the B− bus. The purpose of capacitor C1 is that of providing a low-impedance path for 30 kHz inverter currents. However, it provides substantially no filtering for the full-wave-rectified power line voltage present between the B+ bus and the B− bus.

Thus, the voltage applied to the full-bridge inverter, which consists principally of transistors Qa1, Qa2, Qb1 and Qb2, is a series of unidirectional voltage pulses provided at the rate of 120 pulses per second. The RMS magnitude of this pulsed DC voltage of 120 Volt.

In other words, the RMS magnitude of the DC voltage applied to the full-bridge inverter is 120 Volt; which—as long as the inverter oscillates—makes the RMS magnitude of the inverter output voltage also 120 Volt. Otherwise, the operation of the full-bridge inverter of FIG. 3 is entirely analogous to that of the half-bridge inverter described in U.S. Pat. No. 4,506,318 to Nilssen, including the adjustability of the RMS magnitude of the inverter output voltage.

That is, the RMS magnitude of the output voltage of frequency converter PPFC of FIG. 2 is adjustable by way of varying the magnitude of resistor Rt of frequency converter FC of FIG. 3: a low value for Rt provides for maximum output voltage RMS magnitude, whereas higher values of Rt provides for ever decreasing magnitude. In effect, adjusting the value of Rt in the frequency converter of FIG. 3 is equivalent to adjusting the value of the trigger-point-control potentiometer in an ordinary Triac light dimmer.

The inverter itself-oscillates by way of current feedback provided by the four positive feedback current transformers CTa1, CTa2, CTb1 and CTb2; which means that the inverter will not oscillate without having a load connected between its power output terminals POT. Thus, the inverter used in the frequency converter of FIG. 1 stops oscillating whenever special light bulb SLB is switched OFF or removed.

The special light bulb of FIG. 4 has a filament designed for operation on a voltage of 24 Volt RMS magnitude; which is the voltage magnitude at which—at the power levels normally used with household light bulbs—luminous efficacy reaches its maximally attainable level.

With 120 Volt/30 kHz applied to input terminals IT1 and IT2 of special light bulb SLB, a voltage of 24 Volt/30 kHz is provided to the filament of Tungsten-Halogen lamp THL. Transformer HFT is of construction that is entirely ordinary for frequencies on the order of 30 kHz.

Capacitor HPC is of such value as to represent substantially no impedance for currents at 30 kHz and above, yet representing a substantial impedance to currents at 60 Hz and below; which implies that light bulb SLB would not sustain damage if mistakenly screwed into a lamp socket powered with 120 Volt/60 Hz.

Additional Comments a) Since the voltage provided to the lamp socket in FIG. 1 is of 120 Volt RMS magnitude, ordinary 120 Volt light bulbs may be properly used therein; which means that the utility of the table lamp would not depend on having available one of the special light bulbs. However, it is necessary that the power output capability of the frequency converter be adequate to handle the power required by the largest light bulb that might expectedly be used in the lamp socket.

b) It is anticipated that the outer glass envelope of the special light bulb (GE in FIG. 3) be made removable, thereby to permit replacement of the Tungsten-Halogen lamps; in which case, of course, socket means would be provided for these lamps.

c) In addition to having the value of protecting the special light bulb from damage in case it were to be screwed into a lamp socket powered with 120 Volt/60 Hz, capacitor HPC constitutes a means to prevent potentially damaging magnitudes of direct current from being extracted from the frequency converter when its output is connected to a transformer primary having little or no DC impedance. Such damaging magnitudes of direct current are apt to occur as a result of only slight asymmetries in the waveform of the inverter squarewave output voltage.

However, with a resistive load—such as an ordinary 120 Volt light bulb—the magnitude of the direct current resulting from any asymmetry in the inverter waveform is not apt to constitute a problem.

d) It is anticipated that a control knob may be provided on plug-in/plug-into frequency converter PPFC of FIG. 2; which control knob would be operable to permit adjustment of the magnitude of resistor Rt of FIG. 3, thereby to permit control of the RMS magnitude of the voltage provided at receptacle terminals RT1 and RT2.

e) It is also anticipated that an over-current protection means be included within PPFC, thereby preventing an accidental overload from damaging the frequency converter circuit. However, since means to accomplish such over-current protection is well known, details need not be provided as part of the present invention.

f) In many situations, instead of using a plug-in/plug-into frequency converter, such as depicted in FIG. 1, it may be more feasible to use a plug-in frequency converter that is arranged to be attached to the lamp's power cord in the same manner as is an ordinary power plug. Then, for a retro-fit situation, it would only be necessary to remove the existing power plug from the lamp's power cord, and then connect the power cord with the For convenience, this connection could be accomplished by pierce-through clip-on means.

g) It is believed that the present invention and its several attendant advantages and features will be understood from the preceeding description. However, without departing from the spirit of the invention, changes may be made in its form and in the construction and interrelationships of its component parts, the form herein presented merely representing the presently preferred embodiment.

I claim:

1. A lighting system comprising:

frequency converter means operative: i) to be plugged into an ordinary household electric receptacle, thereby to be connected with the low frequency voltage on an ordinary electric utility power line, and ii) to provide a high-frequency voltage at a high-frequency receptacle means adapted to receive and hold an ordinary electric power plug; the frequency of the high-frequency voltage being substantially higher than that of the low-frequency voltage;

lamp base means having: i) power plug operative to be plugged into a receptacle means receptive of an ordinary electric power plug, and ii) lamp socket operative to receive and hold an ordinary electric light bulb; and special light bulb means being: i) adapted to be inserted into and held by a lamp socket receptive of an ordinary electric light bulb, ii) responsive to and properly operable from the high-frequency voltage provided at the high-frequency receptacle means, and iii) substantially non-responsive to the low-frequency voltage;

whereby the special light bulb means will be responsive and properly operable whenever: i) the frequency converter means is plugged into an ordinary household electric receptacle, ii) the power plug of the lamp base means is plugged into the high-frequency receptacle means, and iii) the special light bulb means is inserted into the lamp socket of the lamp base means;

while the special light bulb means will be non-responsive whenever: i) the power plug of the lamp base means is plugged directly into an ordinary household electric receptacle, and ii) the special light bulb means is inserted into the lamp socket of the lamp base means.

2. The lighting system of claim 1 wherein:

the special light bulb means comprises filament means properly operative to incandesce and to emit light only when powered from a low-magnitude voltage, the low-magnitude voltage having RMS magnitude substantially lower than that of the low-frequency voltage; and the lighting system comprises transformer means operative to provide the low-magnitude voltage to the filament means.

3. The lighting system of claim 1 wherein the RMS magnitude of the high-frequency voltage is about the same as that of the low-frequency voltage.

4. The lighting system of claim 1 wherein the special light bulb comprises:

filament means properly operative to incandesce and to emit light only when powered from a low-magnitude voltage, the low-magnitude voltage having RMS magnitude substantially lower than that of the low-frequency voltage; and transformer means operative to transform high-frequency voltage received by the special light bulb means and, in response thereto, to provide the low-magnitude voltage to the filament means.

5. A lighting product comprising:

lamp base means having: i) lamp socket adapted to receive and hold ordinary incandescent light bulb, and ii) power cord connected between the lamp socket and a special plug means operative to plug into an ordinary household electrical outlet, the special plug means having frequency converter means operative to convert the low-frequency voltage provided by the electrical outlet to a high-frequency voltage, thereby to provide this high-frequency voltage to the lamp socket, the high-frequency voltage being of frequency substantially higher than that of the low-frequency voltage; and special light bulb means being: i) operative to be inserted into and held by a lamp socket adapted to receive and hold an ordinary electric light bulb, and ii) properly operable only from a high-frequency voltage;

whereby the special light bulb means will properly operate whenever: i) the special plug means is plugged into an ordinary household electric receptacle, and ii) the special light bulb means is inserted into the lamp socket of the lamp base means.

6. The lighting product of claim 5 wherein the special light bulb means comprises:

filament means operative to incandesce and emit light whenever powered with a low-magnitude voltage of RMS magnitude substantially lower than that of the low-frequency voltage; and transformer means responsive to high-frequency voltage and operative to provide the low-magnitude voltage.

7. The lighting product of claim 5 wherein the magnitude of the high-frequency voltage provided to the lamp socket of the lamp base means is approximately of the same RMS magnitude as is the low-frequency voltage, thereby permitting the proper use in that lamp socket of an ordinary electric light bulb.

8. A special light bulb comprising:

screw-base adapted to be screwed into an ordinary lamp socket, the screw-base having base terminals;

filament means operative to properly incandesce and emit light only when powered with a voltage of RMS magnitude substantially lower than that of the voltage normally present on an ordinary electric utility power line; and transformer means connected in circuit between the base terminals and the filament means, the transformer means being operative to respond only to a voltage of frequency substantially higher than that of the power line voltage normally present on an ordinary electric utility power line;

whereby the special light bulb is adapted to be properly powered only when provided with a voltage of frequency substantially higher than that of the power line voltage, yet non-responsive when provided with a voltage of frequency as low as that of the power line voltage.

9. The special light bulb of claim 8 wherein the special light bulb is adapted to be properly powered only when provided with a voltage of magnitude about equal to that of the power line voltage.

10. The frequency-converter means of claim 9 wherein the magnitude of the high-frequency voltage is substantially equal to that of the low-frequency voltage, thereby obviating the need for the frequency-converter to comprise a power transformer.

11. A lighting product comprising:

screw-base adapted to be screwed into an ordinary lamp socket; the screw-base having base terminals;

light-emitting means operative to properly operate and emit light only when powered with a voltage of RMS magnitude different from that of the voltage normally present on an ordinary electric utility power line; and voltage conditioning means connected in circuit between the base terminals and the light-emitting means; the voltage conditioning means being operative to respond properly only to a voltage of frequency substantially higher than that of the power line voltage normally present on an ordinary electric utility power line;

the screw-base, the light-emitting means, and the voltage conditioning means being combined into a single integral structure characterized by: (i) being functional as a light source when being provided with a voltage of frequency substantially higher than that of the power line voltage; and (ii) being non-functional when provided with a voltage of frequency as low as that of the power line voltage.

12. The lighting product of claim 11 wherein the light-emitting means includes an incandescent filament.

13. A combination comprising:

an ordinary household electrical receptacle;

load means having a power cord with a power plug of a type that can be plugged-into and held by an electrical receptacle such as said ordinary household electrical receptacle; and housing means including:

(i) prong means having a pair of prong terminals; the prong means being plugged into and held by said household electrical receptacle;

(ii) receptacle means having a pair of receptacle terminals; the receptacle means being operative to receive and hold, and has in fact received and is in fact holding, said power plug; and (iii) frequency-converting voltage conditioning means connected in circuit between the prong terminals and the receptacle terminals;

whereby the housing means: (a) is being held by the ordinary household electrical receptacle; (b) is interposed between the ordinary electrical household receptacle and the power plug; and (c) is providing for the load means to be powered with a voltage of frequency substantially higher than that of the power line voltage normally provided at said ordinary household electrical receptacle.

14. The combination of claim 13 wherein the load means includes light-emitting means.

15. The combination of claim 13 wherein the load means is characterized: (i) by being properly functional only when being provided with a voltage of frequency substantially higher than that of said power line voltage; and (ii) by being non-functional when being provided only with a voltage of frequency as low as that of said power line voltage.

16. A lighting product comprising:

base means adapted to be inserted into and held by a lamp socket; the base means having base terminals;

lamp means having a pair of lamp terminals: the lamp means being operative to function properly only when supplied at its lamp terminals with a voltage of RMS magnitude substantially different from that of the power line voltage normally present on an ordinary electric utility power line;

voltage magnitude-transformation means connected in circuit between the base terminals and the lamp terminals; the voltage magnitude-transformation means being operative to respond properly only to a voltage of frequency substantially higher than that of said power line voltage; and structure means operative to combine into a single integral entity the base means, the lamp means, and the voltage magnitude-transformation means;

thereby to form a lighting product characterized by: (i) functioning properly only when being provided with a voltage of frequency substantially higher than that of the power line voltage; and ii) being non-functional when provided with a voltage of frequency as low as that of the power line voltage.

17. The lighting product of claim 16 wherein: (i) the base means has threads and is operative to be screwed into and held by an ordinary Edison-type lamp socket; and (ii) the lamp means includes an incandescent-type light bulb.

18. The lighting product of claim 16 wherein the voltage magnitude-transformation means includes a transformer.

19. The lighting product of claim 16 wherein the lighting product is shaped in the form of an ordinary household electrical light bulb and is operative to be screwed into and held by an ordinary Edison-type lamp socket.

20. An arrangement comprising:

a lamp holder having a lamp socket with a pair of socket terminals;

a special lamp inserted into and held by said socket terminals; the lamp being characterized by operating properly only when being supplied with a current of frequency substantially higher than the frequency of the power line voltage on an ordinary electric utility power line; and special power plug means connected with the socket terminals by way of a flexible power cord having electrical conductors; the special power plug means having electrical prongs adapted to be plugged-into and held by an ordinary household electrical receptacle; the special power plug means including frequency-converting means connected in circuit between the electrical prongs and the electrical conductors; the frequency-converting means being operative, whenever the electrical prongs are indeed inserted into said receptacle, to supply to the electrical conductors a voltage of frequency substantially higher than the frequency of said power line voltage; the special power plug means being physically supported by said receptacle whenever its electrical prongs are indeed inserted thereinto.

* * * * *